US006402484B1

(12) United States Patent
Svendsen et al.

(10) Patent No.: US 6,402,484 B1
(45) **Date of Patent: *Jun. 11, 2002**

(54) REFRIGERANT COMPRESSOR AND METHOD FOR ASSEMBLING

(75) Inventors: Morten Svendsen, Rødekro; Frank Holm Iversen, Padborg, both of (DK)

(73) Assignee: Danfoss Compressors GmbH, Flensburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/951,064

(22) Filed: Sep. 12, 2001

Related U.S. Application Data

(62) Division of application No. 09/531,975, filed on Mar. 20, 2000.

(30) Foreign Application Priority Data

Apr. 9, 1999 (DE) ..... 199 15 918

(51) Int. Cl.[7] ..... F04B 39/00
(52) U.S. Cl. ..... 417/312; 29/888.05
(58) Field of Search ..... 417/312, 313; 29/888, 888.02, 888.06, 888.044, 888.05

(56) References Cited

U.S. PATENT DOCUMENTS 4,620,475 A * 11/1986 Watts ..... 91/499
5,088,906 A * 2/1992 Richardson, Jr. ..... 418/55.2
5,101,555 A * 4/1992 Hauser ..... 29/888.02
6,109,883 A * 8/2000 Kawaguchi et al. ..... 417/269
6,305,912 B1 * 10/2001 Svendsen et al. ..... 417/312

* cited by examiner

*Primary Examiner*—Teresa Walberg
*Assistant Examiner*—Thor Campbell
(74) *Attorney, Agent, or Firm*—Lee, Mann, Smith, McWilliams, Sweeney & Ohlson

(57) ABSTRACT

The invention concerns a refrigerant compressor with a cylinder block (1), a valve plate (4), a pipe connectable or connected with a suction muffler, a cover (2) covering the valve plate (4), a first sealing (3) between cover and valve plate and a second sealing (5) between valve plate and cylinder block. On assembling the refrigerant compressor it should be provided that the flow resistance of the suction gas is reduced as much as possible. For this purpose, each of the following pairs of members, cover. (2) and pipe (29), pipe (29) and valve plate (4) and valve plate (4) and cylinder block (1), has an alignment device for its members with at least two guiding elements, and that the members (2, 29, 4, 1) are assembled in a direction, which is substantially parallel to the guiding elements.

18 Claims, 5 Drawing Sheets

REFRIGERANT COMPRESSOR AND METHOD FOR ASSEMBLING

RELATED APPLICATION

This application is a division of co-pending U.S. patent application Ser. No. 09/531,975, filed Mar. 20, 2000.

The invention concerns a refrigerant compressor with a cylinder block, a valve plate, a pipe connectable or connected with a suction muffler, a cover covering the valve plate, a first sealing between cover and valve plate and a second sealing between valve plate and cylinder block. The invention further concerns a method for assembling a refrigerant compressor with a cylinder block and a valve plate, the valve plate being, on the side opposite the cylinder block, covered by a cover, which has an opening for the adoption of a pipe, which is connected or connectable with a suction muffler.

The invention particularly concerns a hermetically enclosed refrigeration compressor, comprising an electric motor, which, by means of a rotating shaft and a crank disc connection, drives at least one piston to a reciprocating movement in a cylinder block, the cylinder block being closed by a valve plate, which forms the basis of suction and pressure valves, the valve plate being, on the side opposite the piston, covered by a cover, which has an opening for the adoption of a pipe, which is connected with a suction muffler.

W098/22712 describes an electric compressor, in particular for domestic refrigerators, with a cylinder body, a cylinder head, a valve plate, which is arranged between head and body of the cylinder, and which is provided with a gas suction opening. A muffler is arranged between the inner recess of the compressor housing and the head of the cylinder. The muffler is formed by a central gas suction body and an extended part, which extends away from the body and has an opening for the discharge of the gas contained in the muffler, the opening being adapted to exact engagement with the suction opening of the valve plate. On the outside, the head has a hollow seat or a recess, which is accessible in the direction of the inner volume of the compressor. The extended part of the muffler is adapted for fixed and stable placement in the recess, in a position that permits the corresponding opening to have an exact and tight engagement with the opening of the valve plate, to create a mutual connection between the inside of the muffler and the inside of the cylinder body, and the head is shaped so that it leaves part of the valve plate arranged under it, surrounding the suction opening, uncovered.

This will ensure an optimum gas suction path, as the pipe of the suction muffler is only secured in relation to the valve plate by means of a projection. As the suction muffler is mounted after the cover, a little space must always be available between the members with regard to the mounting, and there is a risk that the pipe of the suction muffler can rotate around the projection, meaning that it would become wry and offset in relation to the suction opening of the valve plate. Therefore, the opening in the pipe of the suction muffler is larger than the suction opening. However, this gives rise to an edge, which causes an eddy formation in the suction gas. Thus, the suction opening gets an active flow area, which is substantially smaller than the geometric area of the opening. The problem can be further aggravated, when the sealing between valve plate and cover is wry or offset.

When producing compressors, a very high accuracy is required, when an optimum mounting or assembling of the compressor top part is desired. Very narrow production tolerances are required. After the welding of the hermetic housing, the compressor can be exposed to a rather careless treatment during transport, which causes the risk that, for example, a suction muffler is displaced, so that the pipe of the suction muffler no longer has the optimum placement in relation to the suction opening. Therefore, the compressor in question will work during its whole life at reduced efficiency.

As the suction muffler is a rigid body, an undesired rotation of the suction muffler will influence its suction pipe. This gives a bad adaptation to the compressor pot, and the efficiency of the compressor will be reduced for its whole life. Further, this bad adaptation can have a negative influence on the noise level of the compressor.

It can be seen that the assembling of the compressor top part or the mounting of the compressor top part on the cylinder block, respectively, can have a substantial influence on the efficiency and the life of the refrigerant compressor. This also applies, when the parts forming the cylinder block or the compressor top part are produced with a relatively high accuracy. A sufficient accuracy in the production of the individual parts is anticipated in the following.

SUMMARY OF THE INVENTION

The invention is based on the task of ensuring, in connection with the assembling of the refrigerant compressor that the flow resistance of the suction gas is as small as possible.

With a refrigerant compressor as described in the introduction, this task is solved in that each of the following pairs of members, cover and pipe, pipe and valve plate and valve plate and cylinder block, has an alignment device for its members with at least two guiding elements, and that the members are assembled in a direction, which is substantially parallel to the guiding elements.

This embodiment does not only ensure that the individual members of each pair of members are assembled with a predetermined alignment in relation to each other. This alignment or placement or positioning in relation to each other will also be maintained for the remaining life of the compressor, so that in this respect no changes of the operating qualities will appear. As all neighbouring pairs of members have one member in common, the alignment device in each pair of members gives an exact alignment of all parts in relation to each other, however without a correlation, which could again lead to an interlocking of individual parts in relation to each other.

Preferably, the guiding elements additionally align the corresponding sealings. Thus, also the sealings between the individual members are guided precisely, and cannot be displaced in a way that they influence the suction opening or the flow path for the suction gas.

Advantageously, the guiding elements are made as pins or bolts. Thus, a displacement of the members of a pair of members in relation to each other is only possible in one direction, namely along the pins or bolts. A sideways movement is reliably prevented. This permits the mounting of the individual members of the compressor top part or the mounting of the compressor top part on the cylinder block in one direction, which simplifies the mounting substantially.

Preferably, guiding elements are made on the pipe. When the pipe is connected with the valve plate or the cover is fitted on the pipe, the individual parts will automatically align correctly in relation to each other.

Preferably, the valve plate is provided with pins, which fit into corresponding holes in the cylinder block. These pins can, for example, be made in advance on the valve plate. In the extreme case, one single pin will be sufficient.

Preferably, a resilient clamp is arranged between the pipe and the cover, which clamp ensures a play between the pipe and the cover. This play can be available both laterally, that is, in a level, which is substantially vertical to the valve plate, and on the top, that is, substantially parallel to the valve plate, between the pipe and the cover. This play ensures a small air volume, which can be used as heat isolation.

Preferably, a clamp bolt serves as guiding element. This clamp bolt secures the correct position of the compressor top part to the cylinder block in one of the last steps of the mounting. This at the same time ensures the axial tension between the compressor top part and its members or the cylinder block, respectively.

Advantageously, an opening in the valve plate, through which the clamp bolt is led, has a cross section in the shape of a, if required, rounded polygon. Thus, the cross section of the opening is easily adapted very accurately to the cross section of the bolt. The bolt only touches the valve plate at a few sidewalls of the polygon, which is sufficient for an exact guiding. This does not significantly prevent the turning of the bolts. At the same time, the bolt ensures the guiding between the valve plate and the cylinder block, so that at this point the second connection is established, beside the connection between the cylinder block and the valve plate, by means of a pin.

Preferably, the valve plate has a suction opening, which is arranged in an indentation, whose edges cooperate with a mouth of the pipe. Thus, the pipe is guided form-fittingly the valve plate, so that a displacement can reliably be prevented. This applies for both assembling and operation.

With a method as mentioned in the introduction, this task is solved in that the cover controls and secures the placement of the pipe, the pipe controlling and securing the placement of the valve plate and a sealing between the cover and the valve plate, and the valve plate, by means of at least one guiding element controlling and securing the placement of the valve plate in relation to the cylinder block, and at least one additional guiding element between cover, valve plate and cylinder block controlling and securing the mutual placement of cylinder block and valve plate.

In this connection, the guiding element can be made as a pin and the additional guiding element as a clamp bolt. The position of the compressor top part in relation to the cylinder block is controlled and secured by the use of at least one pin in the valve plate and a corresponding number of control holes with approximately the same diameter in the block, at least one clamp bolt and a corresponding number of control holes controlling and securing the mutual placement of valve plate and cylinder block. This gives an optimum suction path for the refrigerant from the suction muffler to the suction valve opening, the individual members receiving an optimum mutual placement during production, a placement, which is also secured during the future operation and thus maintained. This increases the efficiency of the compressor and reduces the energy consumption.

Advantageously, the cover can control and secure the placement of the suction muffler or its pipe by means of a resilient member, which retains the pipe of the suction muffler and secures an isolating play between cover and pipe. This secures the retaining of the suction muffler pipe in relation to the cover irrespective of tolerances, and because of the avoidance of a heat conducting contact between cover and suction muffler pipe, the heating of the suction gas is reduced.

The suction opening of the valve plate can be arranged in an indentation, and the edges of the indentation can control and secure the suction muffler pipe, whose mouth cooperates with the edges of the indentation. This gives a high degree of security for a correct placement of the suction muffler pipe in relation to the valve plate. At the same time, the connection gets so tight that the addition of hot refrigerant from the compressor housing as well as noise can be avoided.

The suction muffler or its pipe can have projections, which, by means of holes in both sealing and valve plate, control and secure the mutual placement of the suction muffler and its pipe in relation to the sealing and to the valve plate. Thus, the suction muffler is with a high degree of security retained in the correct position, so that an undesired flow resistance and undesired heat conduction to the suction gas is avoided.

The projections on the suction muffler and its pipe can secure the valve plate and the sealing by means of tolerance compensating elements, which are formed in that the cylinder-shaped projections have several outer edges, which are deformed on assembling. Thus, during assembling a centering of the projections is secured, the sealing in all tolerance pairings also being optimally controlled by the projections.

The valve plate and thus also the compressor top part can control and secure the placement of the valve plate in relation to the cylinder block by means of at least one pin, a hole for the adoption of the pin being made with approximately the same diameter as that of the pin. Thus, the placement of the valve plate in relation to the cylinder is secured. When a piston of the cylinder block is provided with a recess for the adoption of the suction valve at top dead center position of the piston, this recess can be adapted to the embodiment of the suction valve with almost no play, and the dead volume, which cannot be emptied when the piston is at top dead center position, is reduced. Additionally, a sealing with a smaller nominal diameter can be used for the piston hole, as the position of the sealing is precisely controlled.

Advantageously, at least one pin is fixed in the compressor block, the pin retaining and controlling the placement of the suction valve, and one of the pins cooperating with a hole in the valve plate, whose inner diameter is approximately equal to the outer diameter of the pin.

Advantageously, the mutual placement of valve plate and cylinder block can be controlled and secured by at least one clamp bolt between cover, valve plate and cylinder block, the diameter of the bolt being adapted to the holes in valve plate and cylinder block. Thus, the cover can be guided via the pipe of the suction muffler, in relation to the valve plate, which again is guided in relation to the cylinder block. With a precise guiding of the cover in relation to the valve plate, suction and pressure outlet holes can be placed closer to each other, without causing a risk of leaks, as a separating wall in the cover between suction and discharge side is placed with larger accuracy. This also gives the opportunity of larger hole diameters in relation to the cylinder diameter.

Advantageously, one of the holes in the valve plate is made so that a tolerance compensation is ensured in a first direction, whereas an accurate position control is ensured in another direction.

BRIEF DESCRIPTION OF THE DRAWINGS

In the following, the invention is explained in detail on the basis of a preferred embodiment in connection with the drawings, showing.

DESCRIPTION OF THE PREFERRED EMBODIMENTS

Figure 1:
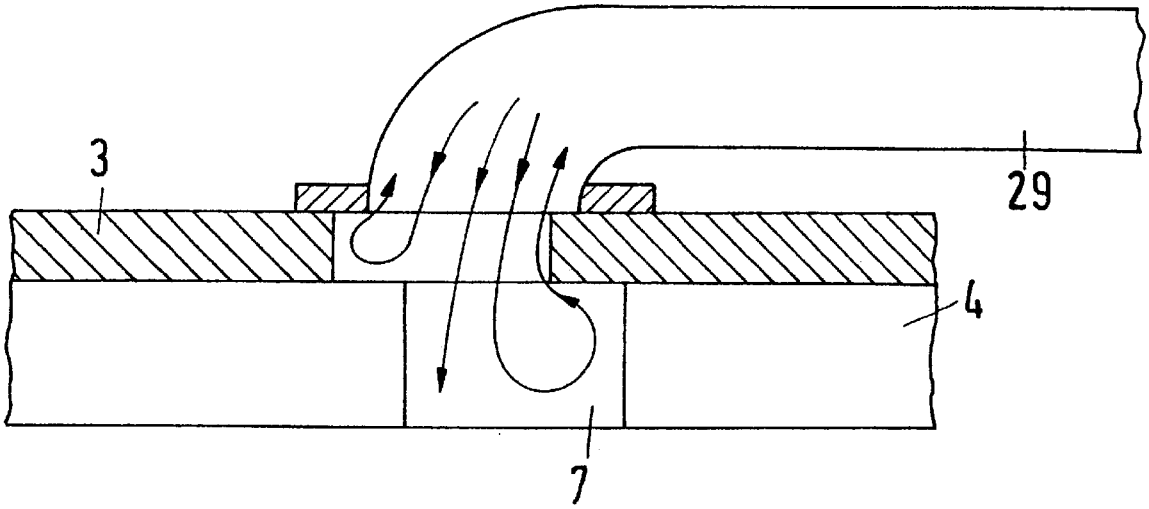
FIG. 1 an inexpedient mounting of the suction path of a compressor

FIG. 1 shows an inexpedient mounting of the suction path of a compressor. A pipe 29 of a suction muffler is offset in relation to a sealing 3, which again is offset in relation to a valve plate 4 and its suction opening 7. The inlet path of the gas is thus reduced, and the flow resistance is increased. This reduces the gas quantity at each cylinder filling. The problem is aggravated by an eddy formation, as shown in FIG. 1, as this may cause a back-flow of the gas. The flow area of the suction path can therefore be substantially reduced in relation to the geometrical area. When, at the same time, the gas flows backwards, the gas quantity can be substantially reduced, thus reducing the efficiency of the compressor.

Figure 2:
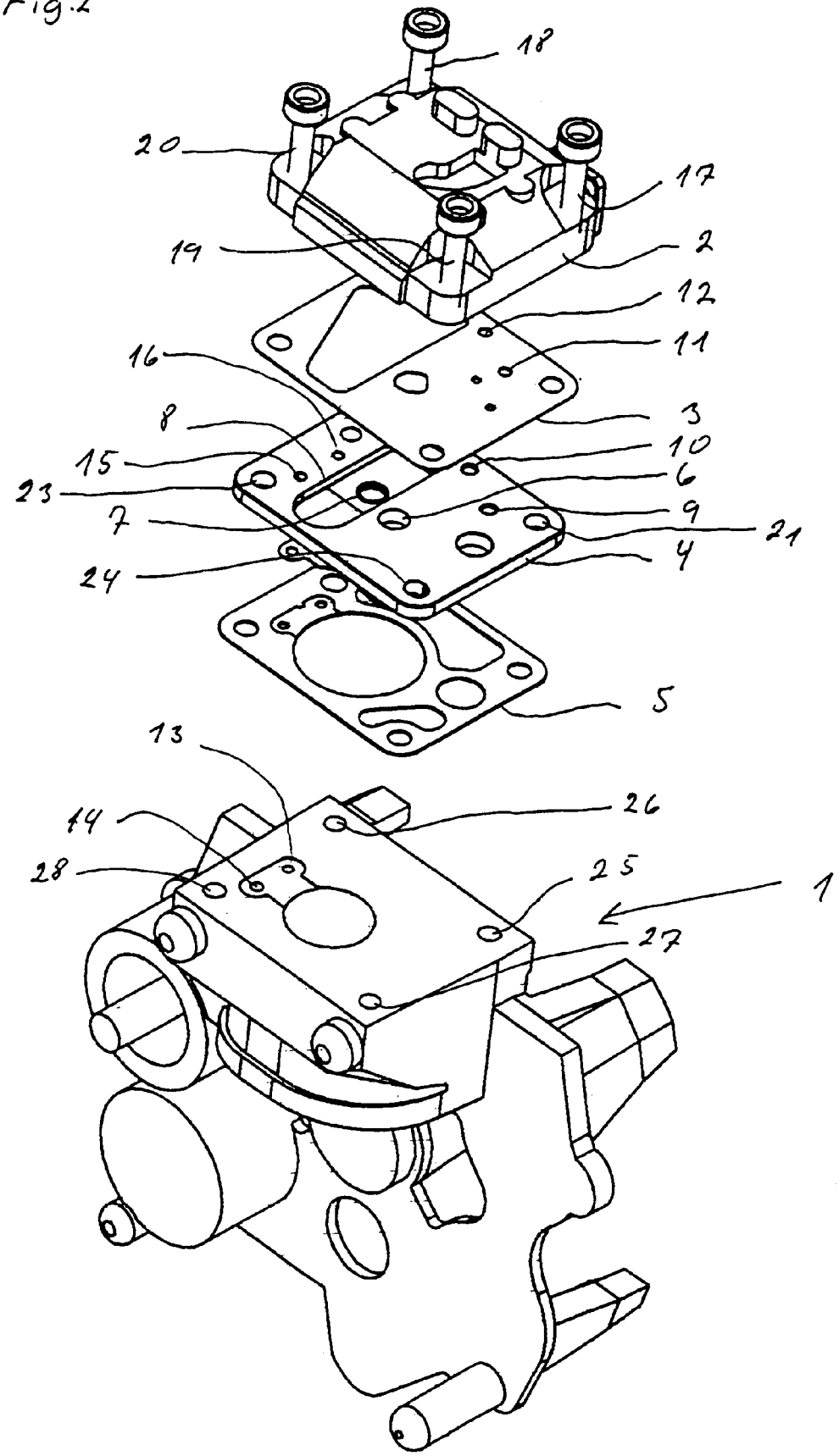
FIG. 2 a dismounted top part of a compressor

FIG. 2 shows a dismounted compressor top part with a cylinder block 1, on which a cover 2, a first sealing 3, a valve plate 4 and a second sealing 5 are mounted. The valve plate 4 has a suction opening 6 and a discharge opening 7, the suction opening 6 being covered under the valve plate by a suction valve 37 (FIG. 4), the discharge opening being closed by a discharge valve (not shown), which can be mounted in an indentation 8. The valve plate 4 has openings 9 and 10 for the adoption of projections 30, 31 on the suction muffler pipe 29 (FIG. 3), the projections 30, 31 being guided through holes in the sealing 3. The suction valve is countersunk in the cylinder block 1, and is retained in holes 13, 14 in the cylinder block by means of pins 35, 36 (FIG. 4), which again are fixed in holes 15, 16 in the valve plate 4.

The assembling of the compressor top part occurs by means of bolts 17, 18, 19, 20. The bolts go through openings in the cover 2 and the first sealing 3, before passing through holes 21, 22, 23, 24 in the valve plate, from where they go through the second sealing 5, before reaching the cylinder block 1, which has threaded holes 26, 27, 28, 29 for the adoption of the bolts 17, 18, 19, 20.

Figure 3:
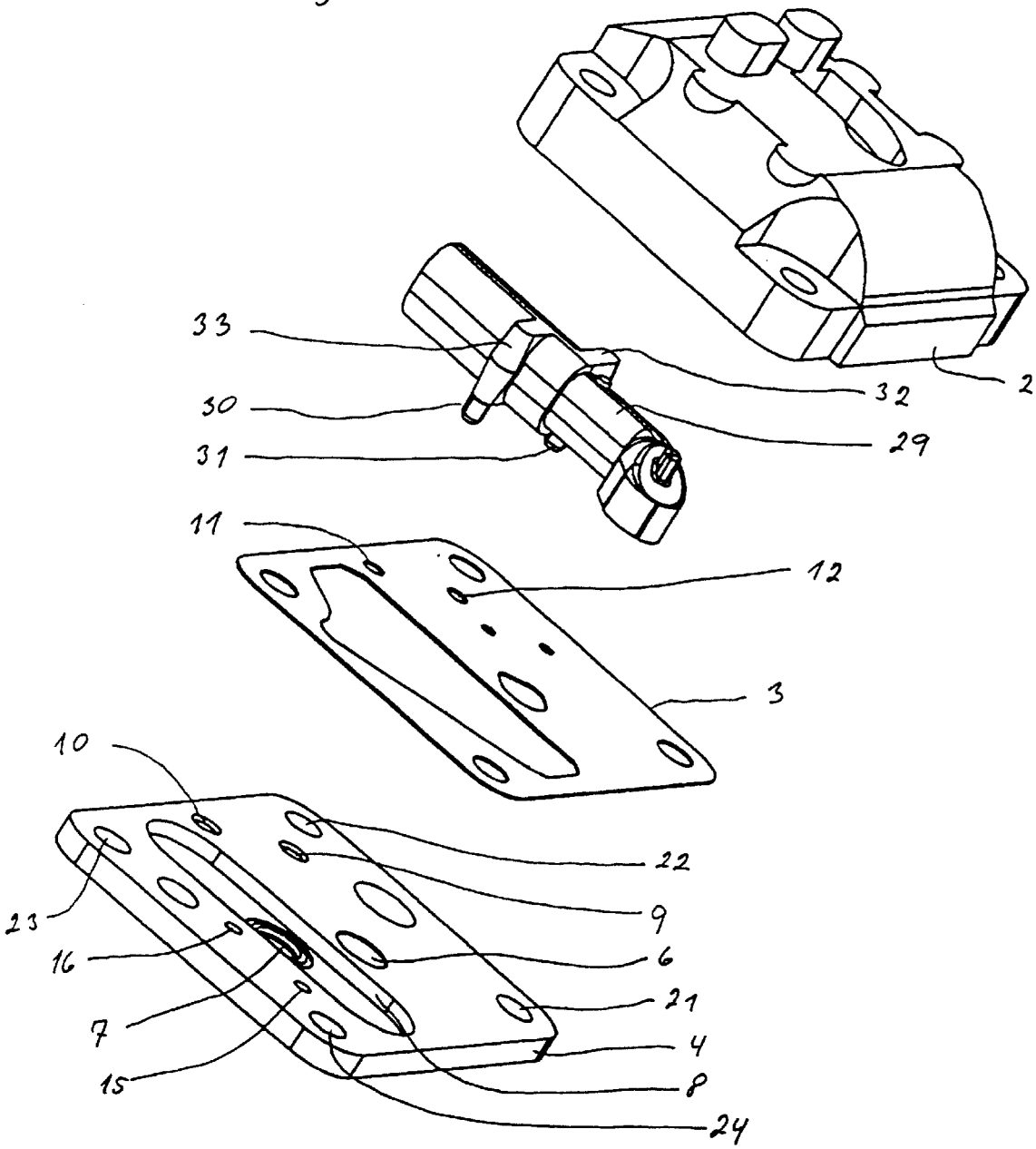
FIG. 3 a cover cooperating with a suction muffler pipe

FIG. 3 shows a cover 2, which cooperates with a suction muffler pipe 29, which is connected with a suction muffler, not shown. The pipe 29 has two projections 30, 31, which cooperate with the holes 11, 12 in the first sealing 3. The projections 30, 31 also cooperate with the holes 9, 10 in the valve plate 4. Additionally, the pipe 29 is provided with projections in the shape of shoulders 32, 33, which cooperate with corresponding recesses 38 in the cover 2 (FIG. 4).

Figure 4:
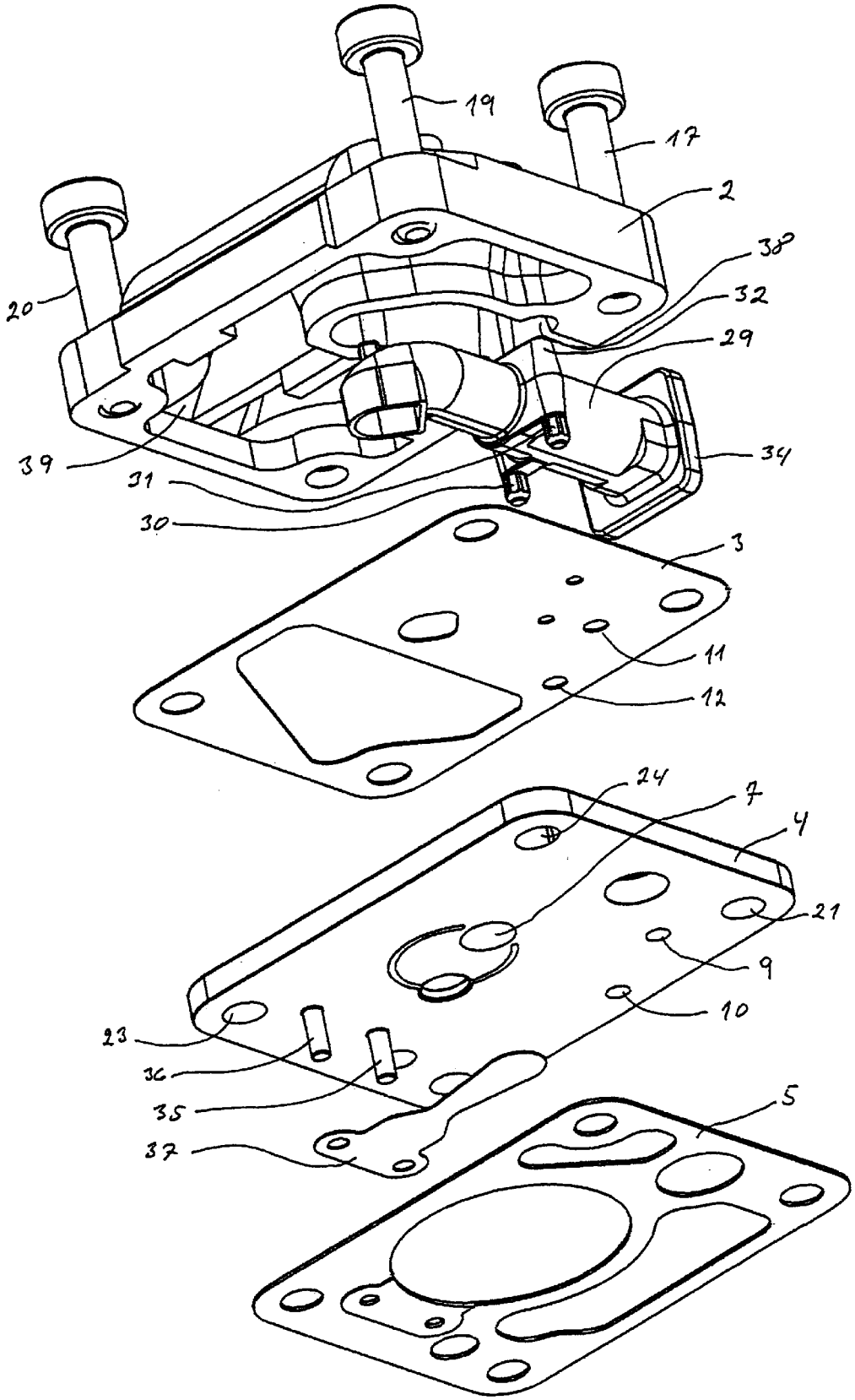
FIG. 4 the compressor top part seen from below

FIG. 4 differs from the FIGS. 1 and 2 in that the compressor top part is seen from below. Thus, the pins 35, 36 of the valve plate and also the suction valve 37 can be seen. The suction valve 37 has holes, which cooperate with the pins 35, 36, thus securing the position of the sealing. The pins extend through the sealing 5 into the holes 13, 14 in the cylinder block 1 (FIG. 1). The cover 2 has a hollow space, which is used for pulsation suppression of the pressurised gas.

When assembling the compressor, firstly, the sealing 3 is placed on the valve plate 4, so that the holes 9, 11 and 10, 12 overlap each other. In these holes the pipe 29 with the projections 30, 31 is inserted, in a way that the pipe 29, the sealing 3 and the valve plate 4 are positioned correctly in relation to each other. The valve 37 is mounted, and the sealing 5 is pushed onto the pins 35, 36. A clamp 41 (FIG. 5) is mounted on the pipe 29, and on this preliminary unit the cover 2 is mounted, which is then positioned exactly on the pipe 29 by means of the recesses 38 and the shoulders 32, 33. The top part can now be mounted on the cylinder block 1. At least one of the pins 35, 36 of the valve plate now fits exactly into one of the corresponding holes 13, 14 in the cylinder block 1. Thus, the translatory placement of the valve plate and thus also of the compressor top part in relation to the cylinder block 1 is ensured. The bolts 17 to 20 are mounted in the cover 2, and in this case the bolt 19 is positioned over the rounded rectangle 24 in the valve plate 4, the top part thus being secured against rotation. The other bolts and screw holes in the sealings 3 and 5, in the cover 2 and in the valve plate 4 have no guiding effect, and only serve the purpose of holding together the top part and the cylinder block.

In this case, the clamp bolt 19 only has to guide the valve plate, and therefore only the guide hole 24 of this bolt must be accurate. The other screw holes are made with such large diameters that they are certain not to have any guiding effect. If they would have a guiding effect, this could lead to a jamming with the piston control system.

Thus, it is ensured that all members are secured in relation to each other with at least two different mechanisms. This reduces the risk of a wry or offset mounting or of the members being displaced during transport or operation, thus keeping the efficiency of the compressor unchanged.

Figure 5:
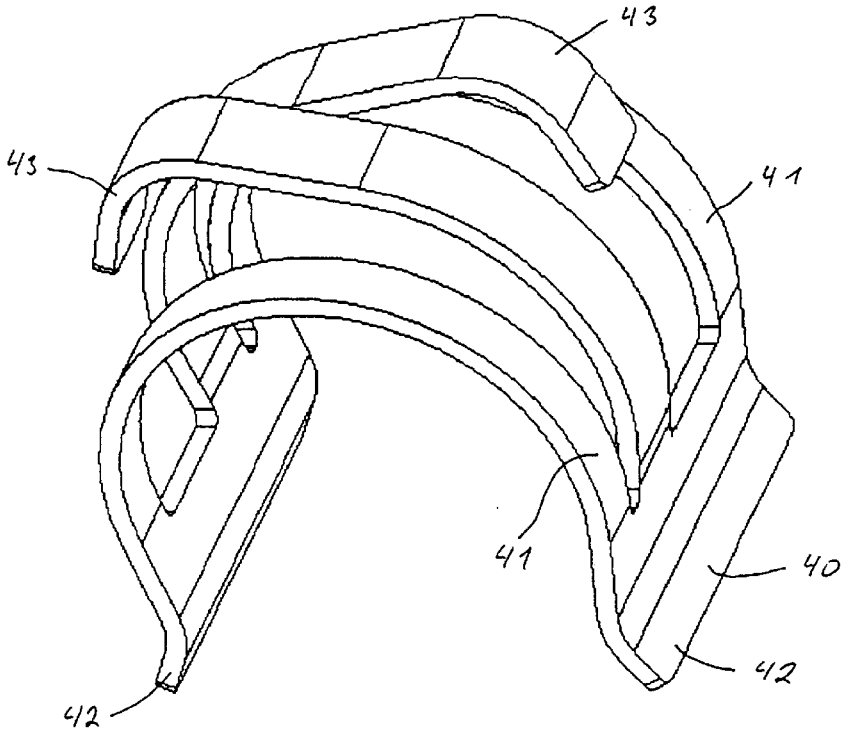
FIG. 5 a clamp, which can be arranged around the pipe connection of the suction muffler FIG. 6 a section through an alternative embodiment of the invention.

FIG. 5 shows the resilient clamp 41, which can be arranged around the pipe connection of the suction muffler. The clamp has supporting legs 42, which, after mounting, bear on the sidewalls of the cover and ensure a play. The clamp 41 also has arms 43, which rest on the cover 2 and provide an isolating play between the suction muffler pipe 29 and the cover 2.

Figure 6:
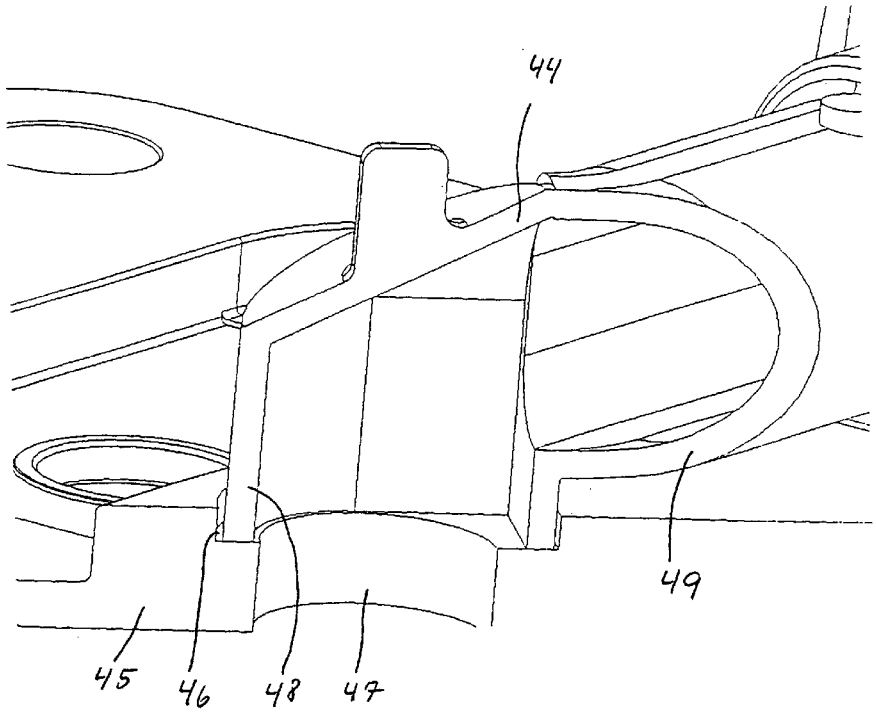

FIG. 6 shows a section through an alternative embodiment of the invention. A pipe 44, which is connected with a suction muffler, is mounted in an indentation 46 in a valve plate 45. The suction muffler pipe has a straight pipe part 49, which is followed by an angle part, which carries a connection 4, which cooperates with the indentation of the valve plate.

For the whole life of the compressor, this method ensures a correct adaptation of the suction path of the compressor. Merely one additional, exactly placed clamp bolt for the guiding of the valve plate and thus the compressor top part is required. The tolerances of the remaining clamping holes in the valve plate, the two sealings and the cover can thus be increased.

What is claimed is:

1. A refrigerant compressor comprising a cylinder block and a valve plate, the valve plate being, a side opposite the cylinder block, covered by a cover which has an opening for the adoption of a pipe which is connectable with a suction muffler, the cover controlling and securing placement of the pipe, the pipe controlling and securing placement of the valve plate and a sealing between the cover and the valve plate, and the valve plate, by means of at least one guiding element, controlling and securing placement of the valve plate in relation to the cylinder block, and including at least one additional guiding element between the cover, valve plate and cylinder block controlling and securing mutual orientation of cylinder block and valve plate.

2. Compressor according to claim 1, in which the cover controls and secures placement of the pipe by means of a resilient member, which retains the pipe of the suction muffler and permits an isolating play between cover and pipe.

3. Compressor according to claim 1, in which the suction opening of the valve plate is located in an indentation having edges which control and secure the suction muffler pipe.

4. Compressor according to claim 1, in which the pipe has projections, which, by means of holes in both the sealing and the valve plate, control and secure mutual placement of the pipe in relation to both the sealing and the valve plate.

5. Compressor according to claim 4, in which projections on the pipe secure the valve plate and the sealing by means of tolerance compensating elements which are deformed on assembling.

6. Compressor according to claim 1, in which the valve plate controls and secures the placement of the valve plate in relation to the cylinder block by means of at least one pin, and including a hole for accomodating the pin having approximately the same diameter as that of the pin.

7. Compressor according to claim 1, including at least one pin fixed in the cylinder block, the pin controlling and securing the placement of the suction valve, and one of the pins cooperating with a hole in the valve plate, the hole having an inner diameter approximately equal to the outer diameter of the pin.

8. Compressor according to claim 1, in which the placement of valve plate and cylinder block is controlled and secured by at least one clamp bolt between the cover, valve plate and cylinder block, the bolt having a diameter being adapted to the hols in valve plate and cylinder block.

9. Compressor according to claim 1, in which one of the holes in the valve plate is made so that a tolerance compensation is ensured in a first direction and an accurate position control in ensured in another direction.

10. A method for assembling a refrigerant compressor with a cylinder block and a valve plate, the valve plate being, on a side opposite the cylinder block, covered by a cover which has an opening for the adoption of a pipe which is connectable with a suction muffler, the cover controlling and securing placement of the pipe, the pipe controlling and securing placement of the valve plate and a sealing between the cover and the valve plate, and the valve plate, by means of at least one guiding element, controlling and securing placement of the valve plate in relation to the cylinder block, and at least one additional guiding element between the cover, valve plate and cylinder block controlling and securing mutual orientation of cylinder block and valve plate.

11. Method according to claim 10, in which the cover controls and secures placement of the pipe by means of a resilient member, which retains the pipe of the suction muffler and permits an isolating play between cover and pipe.

12. Method according to claim 10, in which the suction opening of the valve plate is located in an indentation having edges which control and secured the suction muffler pipe.

13. Method according to claim 10, in which the pipe has projections, which, by means of holes in both the sealing and the valve plate.

14. Method according to claim 13, in which the projections on the suction muffler pipe secure the valve plate and the sealing by means of tolerance compensating elements which are deformed on assembling.

15. Method according to claim 10, which the valve plate controls and secures the placement of the valve plate in relation to the cylinder block by means of at least one pin, a hole for accommodating the pin having approximately the same diameter as that of the pin.

16. Method according to claim 10, including at least on pin fixed in the cylinder block, the pin controlling and securing the placement of the suction valve, and one of the pins cooperating with a hole in the valve plate, the hole having an inner diameter approximately equal to the outer diameter of the pin.

17. Method according to claim 10, in which the placement of valve plate and cylinder block is controlled and secured by at least one clamp bolt between the cover, valve plate and cylinder block, the bolt having a diameter being adapted to the holes in valve plate and cylinder block.

18. Method according to claim 10, in which one of the holes in the valve plate is made so that a tolerance compensation is ensured in a first direction and an accurate position control in ensured in another direction.

* * * * *